US010089948B2

(12) United States Patent
Gao et al.

(10) Patent No.: US 10,089,948 B2
(45) Date of Patent: Oct. 2, 2018

(54) GATE DRIVER ON ARRAY UNIT, RELATED GATE DRIVER ON ARRAY CIRCUIT, DISPLAY DEVICE CONTAINING THE SAME, AND METHOD FOR DRIVING THE SAME

(71) Applicants: BOE TECHNOLOGY GROUP CO., LTD., Beijing (CN); BEIJING BOE DISPLAY TECHNOLOGY CO., LTD., Beijing (CN)

(72) Inventors: Yingqiang Gao, Beijing (CN); Huabin Chen, Beijing (CN); Dongliang Wang, Beijing (CN); Xiaopeng Cui, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/529,613

(22) PCT Filed: Dec. 12, 2016

(86) PCT No.: PCT/CN2016/109406

§ 371 (c)(1),
(2) Date: May 25, 2017

(87) PCT Pub. No.: WO2017/166867

PCT Pub. Date: Oct. 5, 2017

(65) Prior Publication Data

US 2018/0197496 A1 Jul. 12, 2018

(30) Foreign Application Priority Data

Mar. 30, 2016 (CN) ..... 2016 1 0192823

(51) Int. Cl.
*G09G 3/36* (2006.01)

(52) U.S. Cl.
CPC ... *G09G 3/3677* (2013.01); *G09G 2310/0291* (2013.01); *G09G 2310/08* (2013.01); *G09G 2320/0219* (2013.01)

(58) Field of Classification Search
CPC ..... G09G 3/3677; G09G 2310/0291; G09G 2320/0219; G09G 2310/08
See application file for complete search history.

(56) References Cited

U.S. PATENT DOCUMENTS

2011/0058640 A1 3/2011 Shang et al.
2012/0262438 A1 10/2012 Shang et al.
(Continued)

FOREIGN PATENT DOCUMENTS

CN 102012591 A 4/2011
CN 102629444 A 8/2012
(Continued)

OTHER PUBLICATIONS

State Intellectual Property Office of the P.R.C (SIPO) Office Action 1 for 201610192823.8 dated Aug. 28, 2017 21 Pages (including translation).

(Continued)

*Primary Examiner* — Amit Chatly
(74) *Attorney, Agent, or Firm* — Anova Law Group, PLLC

(57) ABSTRACT

The present application discloses a gate driver on array (GOA) unit, including: a buffering module, a pull-up module, a pull-down module, a retaining module, a charging module, and a discharging module, a pull-up node being coupled to the buffering module, the discharging module, the pull-up module, and the charging module, and a pull-down node being coupled to the discharging module and the retaining module. The buffering module, being coupled to an input signal terminal and a pull-up node and controlled by a (Continued)

voltage of the input signal terminal, is configured to output the voltage of the input signal terminal into the pull-up node. The pull-up module, being coupled to a first clock signal terminal, the pull-up node, and an output signal terminal and controlled by a voltage of the pull-up node, is configured to output a voltage of the first clock signal terminal into the output signal terminal.

13 Claims, 6 Drawing Sheets

(56) References Cited

U.S. PATENT DOCUMENTS

2013/0088265 A1* 4/2013 Chen ..... H03K 5/153 327/108
2014/0176410 A1* 6/2014 Ma ..... G09G 3/3622 345/92
2015/0371716 A1* 12/2015 Shao ..... G11C 19/287 345/100
2016/0266699 A1 9/2016 Zhao et al.
2017/0033125 A1 2/2017 Umezaki

FOREIGN PATENT DOCUMENTS

| | | | |
|---|---|---|---|
| CN | 102651238 | A | 8/2012 |
| CN | 102693692 | A | 9/2012 |
| CN | 103050106 | A | 4/2013 |
| CN | 203760057 | U | 8/2014 |
| CN | 104021769 | A | 9/2014 |
| CN | 104078017 | A | 10/2014 |
| CN | 105632446 | A | 6/2016 |
| JP | 2014160533 | A | 9/2014 |
| WO | 2015191253 | A1 | 12/2015 |

OTHER PUBLICATIONS

The World Intellectual Property Organization (WIPO) International Search Report and Written Opinion for PCT/CN2016/109406 dated Mar. 1, 2017; 14 pages.

* cited by examiner

GATE DRIVER ON ARRAY UNIT, RELATED GATE DRIVER ON ARRAY CIRCUIT, DISPLAY DEVICE CONTAINING THE SAME, AND METHOD FOR DRIVING THE SAME

CROSS-REFERENCE TO RELATED APPLICATION

This application is a national phase entry under 35 U.S.C. § 371 of PCT patent application No. PCT/CN2016/109406, filed on Dec. 12, 2016, which claims priority of Chinese Patent Application No. 201610192823.8, filed Mar. 30, 2016, the entire contents of both of which are incorporated herein by reference.

TECHNICAL FIELD

The present invention relates to display technology, more particularly, to a gate driver on array (GOA) unit, a related GOA unit, a display device containing the GOA unit, and a method for driving the GOA unit.

BACKGROUND

Liquid crystal display (LCD) devices often include active-matrix LCDs (AMLCDs) and passive-matrix LCDs (PMLCDs). In an AMLCD, each pixel includes a thin-film transistor (TFT). Often, the gate electrode of the TFT is coupled to a horizontally arranged scanning line, i.e., horizontal scanning line. The drain electrode of the TFT is coupled to a vertically arranged data line, i.e., vertical data line. The source electrode of the TFT is coupled to a pixel electrode. A suitable voltage is applied on the horizontal scanning line to turn on all the TFTs coupled to the horizontal scanning line such that the pixel electrodes coupled to these TFTs are electrically coupled to the vertical data lines. Display signals transmitted by the vertical data lines can be written into corresponding pixels to control the light-transmission levels of the LC molecules. By controlling the light-transmission levels, the colors displayed by the AMLCD can be controlled or changed.

Currently, an external gate driving integrated circuit or gate driving IC coupled to the display panel is often used to drive the horizontal scanning lines in the display panel of an AMLCD. The gate driving IC is often configured to control the charging and discharging of each level of horizontal scanning lines. Meanwhile, gate driver on array (GOA) technology integrates the gate driving ICs on the array substrate. By applying the GOA technology, fewer GOA ICs need to be used in the AMLCD device. The fabrication cost and power consumption of the AMLCD device can be reduced. The GOA technology also enables narrow bezel to be formed in the AMLCD device.

However, in a conventional GOA unit, parasitic capacitance in the transistor of the pull-up module often causes the pull-up node, i.e., the node connecting the gate electrode of the transistor in the pull-up module and the gate output terminal, susceptible to noise.

SUMMARY

In one aspect, the present invention provides a gate driver on array (GOA) unit, including: a buffering module, a pull-up module, a pull-down module, a retaining module, a charging module, and a discharging module, a pull-up node being coupled to the buffering module, the discharging module, the pull-up module, and the charging module, and a pull-down node being coupled to the discharging module and the retaining module. The buffering module, being coupled to an input signal terminal and a pull-up node and controlled by a voltage of the input signal terminal, is configured to output the voltage of the input signal terminal into the pull-up node. The pull-up module, being coupled to a first clock signal terminal, the pull-up node, and an output signal terminal and controlled by a voltage of the pull-up node, is configured to output a voltage of the first clock signal terminal into the output signal terminal. The pull-down module, being coupled to the output signal terminal, a reset signal terminal, and a power signal terminal and controlled by a voltage of the reset signal terminal, is configured to output a voltage of the power signal terminal into the output signal terminal. The retaining module, being coupled to the first clock signal terminal, the power signal terminal, the pull-up node, the pull-down node, and a second clock signal terminal and controlled by a voltage of the second clock signal terminal, is configured to output the voltage of the second clock signal terminal into the pull-down node or write a voltage of the first clock signal terminal into the pull-down node. The charging module, being coupled to the pull-up node and the output signal terminal, is configured to store voltages of the pull-up node and the output signal terminal. The discharging module, being coupled to the reset signal terminal, the pull-up node, the power signal terminal, the pull-down node, and the output signal terminal, is configured to output the voltage of the power signal terminal into the pull-up node or into the output signal terminal when the discharging module is controlled by voltages of the pull-down node and the reset signal terminal, and configured to write the voltage of the power signal terminal into the pull-up node and the output signal terminal when the discharging module is controlled by the voltage of the pull-down node.

Optionally, the retaining module further includes a first transistor, a second transistor, a third transistor, a fourth transistor, a fifth transistor, and a diode, the first transistor having a first electrode coupled to the second clock signal terminal, a second electrode of the first transistor coupled to a switch electrode of the second transistor, a switch electrode of the fifth transistor, and a second electrode of the fourth transistor, and a switch electrode of the first transistor coupled to the second clock signal terminal; the second transistor having a first electrode coupled to the second clock signal terminal, a second electrode coupled to the pull-down node; the third transistor having a first electrode coupled to the power signal terminal, a second electrode coupled to the pull-down node, and a switch electrode coupled to the pull-up node and a switch electrode of the fourth transistor; the fourth transistor having a first electrode coupled to the power signal terminal; the fifth transistor having a first electrode coupled to a cathode of the diode, and a second electrode coupled to the pull-down node; and the diode having an anode coupled to the first clock signal terminal.

Optionally, the buffering module further includes a sixth transistor, the sixth transistor having a first electrode coupled to the input signal terminal, a second electrode coupled to the pull-up node, and a switch electrode coupled to the input signal terminal.

Optionally, the pull-up module includes a seventh transistor, the seventh transistor having a first electrode coupled to the first clock signal terminal, a second electrode coupled to the output signal terminal, and a switch electrode coupled to the pull-up node.

Optionally, the pull-down module includes an eighth transistor, the eighth transistor having a first electrode coupled to the power signal terminal, a second electrode coupled to the output signal terminal, and a switch electrode coupled to the reset signal terminal.

Optionally, the charging module includes a capacitor, the capacitor having a terminal coupled to the pull-up node, and another terminal coupled to the output signal terminal.

Optionally, the discharging module includes a ninth transistor, a tenth transistor, and an eleventh transistor, the ninth transistor having a first electrode coupled to the power signal terminal, a second electrode coupled to the pull-up node, and a switch electrode coupled to the reset signal terminal; the tenth transistor having a first electrode coupled to the power signal terminal, a second electrode coupled to the pull-up node, and a switch electrode coupled to the pull-down node; and the eleventh transistor having a first electrode coupled to the power signal terminal, a second electrode coupled to the output signal terminal, and a switch electrode coupled to the pull-down node.

Optionally, the first transistor, the second transistor, the third transistor, the fourth transistor, the fifth transistor, the sixth transistor, the seventh transistor, the eighth transistor, the ninth transistor, the tenth transistor, and the eleventh transistor are N-type transistors.

Optionally, the first electrode of any of the transistors is a source electrode, the second electrode of any of the transistors is a drain electrode, and the switch electrode of any of the transistors is a gate electrode.

Another aspect of the present disclosure provides a method for driving a disclosed GOA unit, including implementing a pull-down stage and a retaining stage. The pull-down stage includes: applying a first-level voltage on the first clock signal terminal, the input signal terminal, and the power signal terminal; applying a second-level voltage on the second clock signal terminal and the reset signal terminal; applying the second-level voltage on a terminal of the discharging module coupled to the retaining module, applying the first-level voltage on the output signal terminal. The retaining stage includes: applying the first-level voltage on the second clock signal terminal, the input signal terminal, the reset signal terminal, and the power signal terminal; applying the second-level voltage on the first clock signal terminal; applying the second-level voltage on the pull-down node; and applying the first-level voltage of the power signal terminal on the pull-up node and the output signal terminal.

Optionally, the first-level voltage is a voltage of low voltage level and the second-level voltage is a voltage of high voltage level.

Optionally, the retaining module includes the first transistor, the second transistor, the third transistor, the fourth transistor, the fifth transistor, and the diode; the buffering module includes the sixth transistor; the pull-up module including the seventh transistor; the pull-down module includes the eighth transistor; the charging module includes the capacitor; the discharging module includes the ninth transistor, the tenth transistor, and the eleventh transistor. In the pull-down stage, the first-level voltage is applied on the first clock signal terminal, the input signal terminal, and the power signal terminal, and the second-level voltage is applied on the second clock signal terminal and the reset signal terminal, so that, the first transistor, the second transistor, the fifth transistor, the eighth transistor, the ninth transistor, the tenth transistor, and the eleventh transistor are turned on, the second transistor writing the second-level voltage of the second clock signal terminal into the pull-down node, the tenth transistor and the ninth transistor writing the first-level voltage of the power signal terminal into the pull-up node, the eleventh transistor and the eighth transistor writing the first-level voltage of the power signal terminal into the output signal terminal; and in the retaining stage, a first-level voltage is applied on the second clock signal terminal, the input signal terminal, the reset signal terminal, and power signal terminal, and a second-level voltage is applied on the first clock signal terminal, so that, the second transistor, the fifth transistor, the tenth transistor, and the eleventh transistor are turned on, the fifth transistor writing the second-level voltage of the first clock signal terminal into the pull-down node, the tenth transistor writing the first-level voltage of the power signal terminal into the pull-up node and the output signal terminal.

Another aspect of the present disclosure provides a GOA circuit, including at least two disclosed GOA units cascading together.

Another aspect of the present disclosure provides a display device, including one or more of the disclosed GOA units.

BRIEF DESCRIPTION OF THE FIGURES

The following drawings are merely examples for illustrative purposes according to various disclosed embodiments and are not intended to limit the scope of the present invention.

FIG. 2(*b*) illustrates a conventional GOA unit;

FIG. 3(*b*) illustrates an exemplary timing diagram of certain voltage signals according to the embodiment illustrated in FIG. 3(*a*); and FIG. 3(*c*) illustrates an exemplary timing diagram of certain voltage signals according to the embodiment illustrated in FIG. 2(*b*).

DETAILED DESCRIPTION

Figure 1:
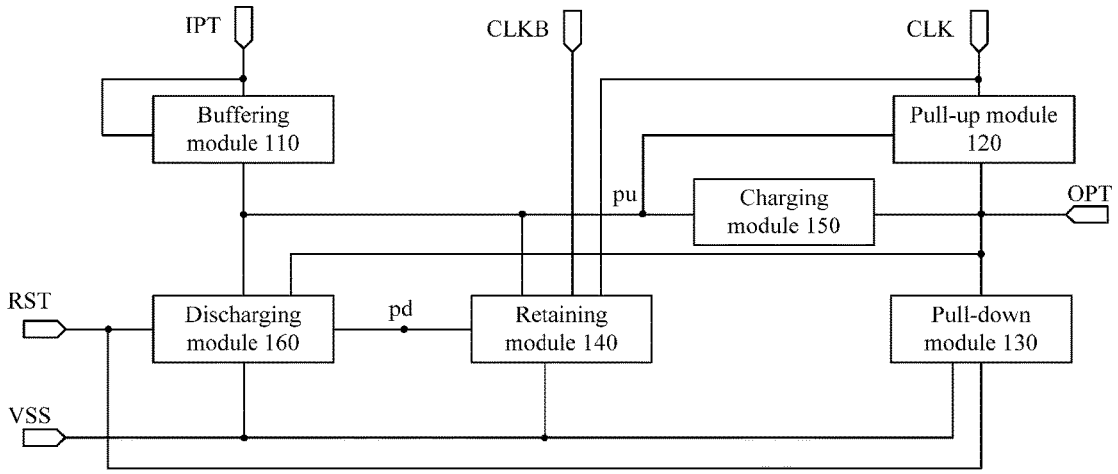
FIG. 1 illustrates an exemplary GOA unit according to some embodiments of the present disclosure.

The disclosure will now describe more specifically with reference to the following embodiments. It is to be noted that the following descriptions of some embodiments are presented herein for purpose of illustration and description only. It is not intended to be exhaustive or to be limited to the precise form disclosed.

Often, a conventional GOA circuit includes a plurality of cascading GOA units. Each GOA unit corresponds to a pixel group, where one pixel group includes a plurality of pixels. A conventional GOA unit often includes a buffering module, a pull-up module, a pull-down module, a retaining module, a charging module, and a discharging module. The buffering module is used as the input module of the GOA unit for inputting the output voltage, of the gate output terminal of the gate of the previous level, into the present GOA unit. The pull-up module is often configured to pull the output voltage of the gate output terminal up to a high voltage level. The pull-down module is often configured to pull the output voltage of the gate output terminal to a low voltage level. The retaining module is often configured to retain the voltage level of the output voltage of the gate output terminal. The charging module is often configured to ensure the transistor contained in the pull-up module to be turned on properly during operation. The discharging module is often configured to discharge the charging module and turn off the pull-up module.

In a discharging-retaining phase, the transistor contained in the pull-up module of the conventional GOA unit often has parasitic capacitance. The voltage at the pull-up node, i.e., the node connecting to the gate electrode of the transistor in the pull-up module, is pulled up to a higher voltage level. As a result, the transistor in the pull-up module is turned on, and the first clock signal of the GOA unit starts charging the gate output terminal again. Thus, noise exists at the pull-up node and the gate output terminal.

The transistors used in the embodiments of the present disclosure may be TFTs, field effect transistors (FETs), and/or any other suitable devices with similar properties. Based on the functions of a transistor in a circuit, the transistors applied in the embodiments of the present disclosure are mostly switching transistors. Because the source electrode and the drain electrode of a switching transistor are symmetric, the source electrode and the drain electrode of a switching transistor can switch or exchange. In the disclosed embodiments, to distinguish the source electrode and the drain electrode from the gate electrode, the source electrode is referred as a first electrode and the drain electrode is referred as a second electrode. Accordingly, a gate electrode is referred as a switch electrode. For illustrative purposes, in the figures of the present disclosure, the gate electrode of a transistor is located at the middle terminal of the transistor, the source electrode is located at the input signal terminal, and the drain electrode is located at the output signal terminal. The switching transistors used in the embodiments of the present disclosure may be N type switching transistors, which can be turned on when a high-level voltage is applied on the gate electrode of a switching transistor and are turned off when a low-level voltage is applied on the gate electrode of a switching transistor. In the present disclosure, the first-level voltage is a low-level voltage and the second-level voltage is a high-level voltage.

In the present disclosure, for illustrative purposes, the term "a voltage of a certain object", "a voltage at a certain location", or the alike may represent the voltage provided, outputted and/or applied by the object or location. The object or location may be any suitable signal terminals and/or nodes in a circuit. Also, the voltage level of a terminal may represent the voltage level of the signal/voltage applied by the terminal.

One aspect of the present disclosure provides a GOA unit.

The GOA unit according to the present disclosure may include a buffering module, a pull-up module, a pull-down module, a retaining module, a charging module, and a discharging module. In a GOA unit of the present disclosure, the retaining module, controlled by the voltage of a clock signal terminal, may write the voltage of the clock signal terminal into the pull-down node or may write the voltage of the first clock signal terminal into the pull-down node. The discharging module, controlled by the voltages of the pull-down node and the reset signal terminal, may write the voltage of the power signal terminal into the pull-up node or into the output signal terminal. As a result, embodiments of the present disclosure may lower the voltages at the pull-up node and the output signal terminal, and reduce the noise at the pull-up node and the output signal terminal of the GOA unit.

FIG. 1 illustrates an exemplary GOA unit provided by the embodiments of the present disclosure. As shown in FIG. 1, the GOA unit may include a buffering module 110, a pull-up module 120, a pull-down module 130, a retaining module 140, a charging module 150, and a discharging module 160.

The buffering module 110 may be coupled to an input signal terminal IPT and a pull-up node pu. Controlled by the voltage of the input signal terminal IPT, the buffering module 110 may write the voltage of the input signal terminal IPT into the pull-up node pu. In the present disclosure, being "coupled to" may refers to any suitable direct or indirect connection, e.g., electrical connection or mechanical connection, between two objects.

The pull-up module 120 may be coupled to the first clock signal terminal CLK, the pull-up node pu, and an output signal terminal OPT. Controlled by the voltage of the pull-up node pu, the pull-up module 120 may write the voltage of the first clock signal terminal CLK into the output signal terminal OPT.

The pull-down terminal 130 may be coupled to the output signal terminal OPT, a reset signal terminal RST, and a power signal terminal VSS. Controlled by the voltage of the reset signal terminal RST, the pull-down module 130 may write the voltage of the power signal terminal VSS into the output signal terminal OPT.

The retaining module 140 may be coupled to the first clock signal terminal CLK, the power signal terminal VSS, the pull-up node pu, a pull-down node pd, and a second clock signal terminal CLKB. Controlled by the voltage of the second clock signal terminal CLKB, the retaining module 140 may write the voltage of the second clock signal terminal CLKB into the pull-down node pd. Alternatively, controlled by the voltage of the second signal terminal CLKB, the regaining module 140 may write the voltage of the first clock signal terminal CLK into the pull-down node pd.

The charging module 150 may be coupled to the pull-up node pu and the output signal terminal OPT to store the voltages of the pull-up node pu and the output signal terminal OPT.

The discharging module 160 may be coupled to the reset signal terminal RST, the pull-up node pu, the power signal terminal VSS, the pull-down terminal pd, and the output signal terminal OPT. Controlled by the voltages of the pull-down node pd and the reset signal terminal RST, the discharging module 160 may write the voltage of the power signal terminal VSS into the pull-up node pu or into the output signal terminal OPT. Alternatively, controlled by the voltage of the pull-down node pd, the discharging module 160 may write the voltage of the power signal terminal VSS into the pull-up node pu and the output signal terminal OPT.

According to the disclosed GOA unit, the retaining module, controlled by the voltage of the second clock signal terminal, may write the voltage of the second clock signal terminal to the pull-down node or write the voltage of the first clock signal terminal to the pull-down node. Thus, the discharging module, controlled by the voltages of the pull-down node and the reset signal terminal, may write the voltage of the power signal terminal to the pull-up node or to the output signal terminal. Compared to conventional technology, the voltages at the pull-up node and the output signal terminal may be lower, and noise at the pull-up node and the output signal terminal of the disclosed GOA unit may be reduced.

Figure 2A:
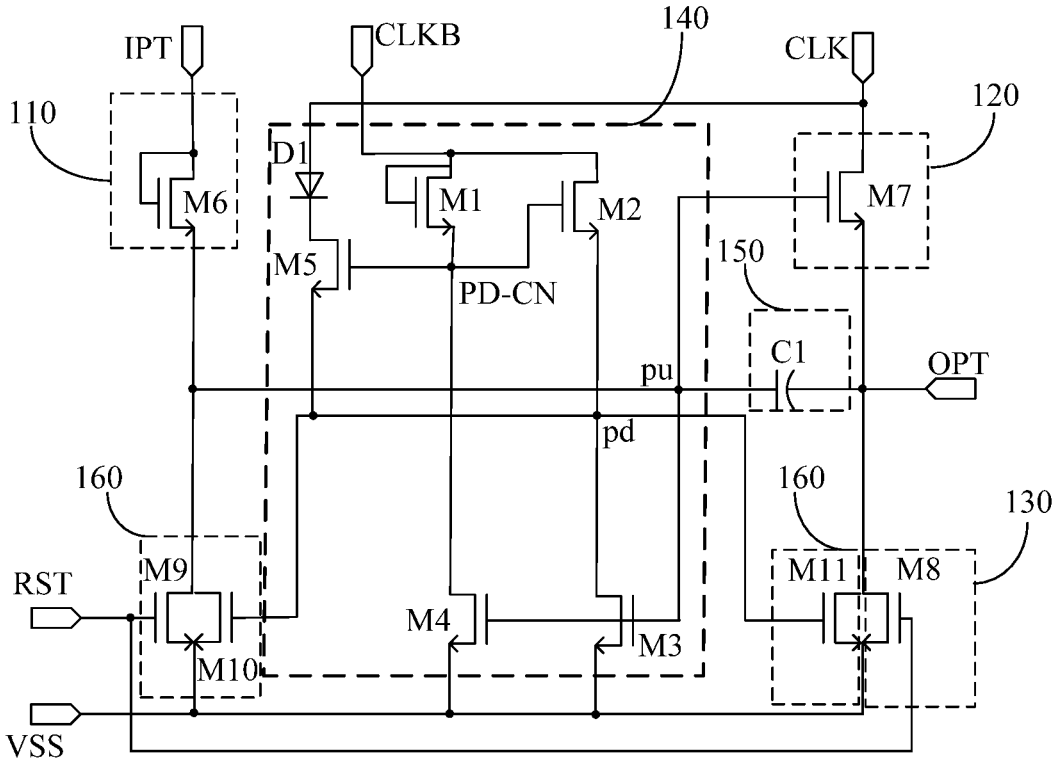
FIG. 2(*a*) illustrates a circuit diagram of an exemplary GOA unit according to some embodiments of the present disclosure.
Figure 2B:
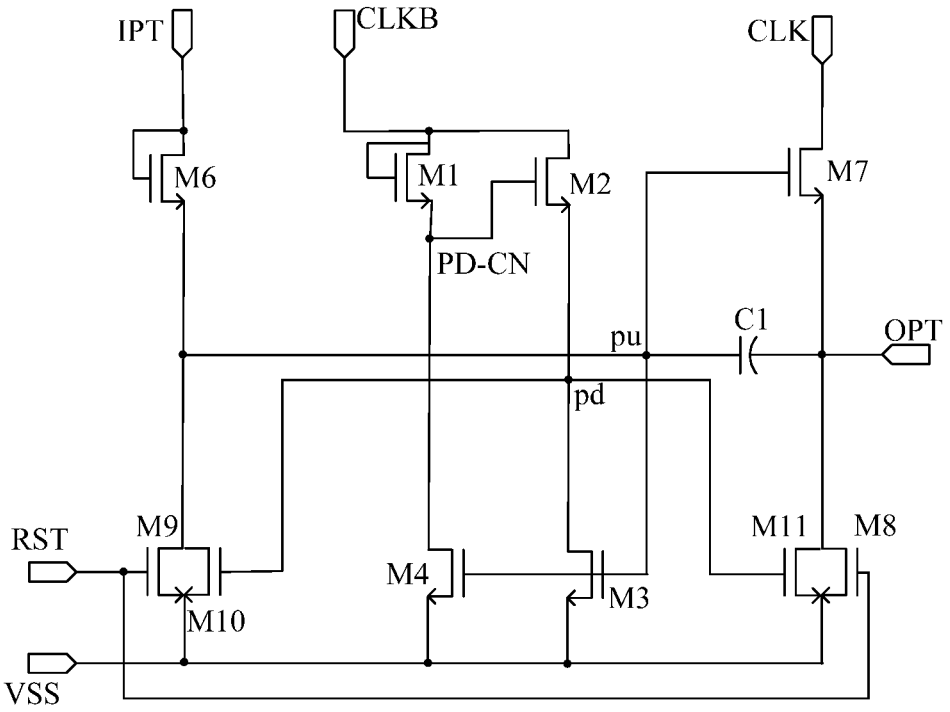
FIG. 2(b) Prior Art

Further, FIG. 2(*a*) illustrates the structure of an exemplary GOA unit.

As shown in FIG. 2(*a*), the GOA unit may include a buffering module 110, a pull-up module 120, a pull-down module 130, a retaining module 140, a charging module 150, and a discharging module 160.

The buffering module 110 may be coupled to the input signal terminal IPT and the pull-up node pu. Controlled by the voltage of the input signal terminal IPT, the buffering module 110 may write the voltage of the input signal terminal IPT into the pull-up node pu.

The pull-up module 120 may be coupled to the first clock signal terminal CLK, the pull-up node pu, and the output signal terminal OPT. Controlled by the voltage of the pull-up node pu, the pull-up module 120 may write the voltage of the first clock signal terminal CLK into the output signal terminal OPT.

The pull-down terminal 130 may be coupled to the output signal terminal OPT, the reset signal terminal RST, and the power signal terminal VSS. Controlled by the voltage of the reset signal terminal RST, the pull-down module 130 may write the voltage of the power signal terminal VSS into the output signal terminal OPT.

The retaining module 140 may be coupled to the first clock signal terminal CLK, the power signal terminal VSS, the pull-up node pu, the pull-down node pd, and the second clock signal terminal CLKB. Controlled by the voltage of the second clock signal terminal CLKB, the retaining module 140 may write the voltage of the second clock signal terminal CLKB into the pull-down node pd or write the voltage of the first clock signal terminal CLK into the pull-down node pd.

The charging module 150 may be coupled to the pull-up node pu and the output signal terminal OPT to store the voltages of the pull-up node pu and the output signal terminal OPT.

The discharging module 160 may be coupled to the reset signal terminal RST, the pull-up node pu, the power signal terminal VSS, the pull-down terminal pd, and the output signal terminal OPT. Controlled by the voltages of the pull-down node pd and the reset signal terminal RST, the discharging module 160 may write the voltage of the power signal terminal VSS into the pull-up node pu or write the voltage of the power signal terminal VSS to the output signal terminal OPT. Alternatively, controlled by the voltage of the pull-down node pd, the discharging module 160 may write the voltage of the power signal terminal VSS to the pull-up node pf and the output signal terminal OPT.

As shown in FIG. 2(*a*), the retaining module 140 may include a first transistor M1, a second transistor M2, a third transistor M3, a fourth transistor M4, a fifth transistor M5, and a diode D1.

The first electrode of the first transistor M1 may be coupled to the second clock signal terminal CLKB. The second electrode of the first transistor M1 may be coupled to the switch electrode of the second transistor M2, a switch electrode of the fifth transistor M5, and the second electrode of the fourth transistor M4. The switch electrode of the first transistor M1 may be coupled to the second clock signal terminal CLKB. The node PD-CN in FIG. 2(*a*) may be a node connecting the second electrode of the first transistor M1 and the switch electrode of the second transistor M2.

The first electrode of the second transistor M2 may be coupled to the second clock signal terminal CLKB. The second electrode of the second transistor M2 may be coupled to the pull-down node pd.

The first electrode of the third transistor M3 may be coupled to the power signal terminal VSS. The second electrode of the third transistor M3 may be coupled to the pull-down node pd. The switch electrode of the third transistor M3 may be coupled to the pull-up node pu and the switch electrode of the fourth transistor M4.

The first electrode of the fourth transistor M4 may be coupled to the power signal terminal VSS.

The first electrode of the fifth transistor M5 may be coupled to the cathode of the diode D1. The second electrode of the fifth transistor M5 may be coupled to the pull-down node pd.

The anode of the diode D1 may be coupled to the first clock signal terminal CLK.

The buffering module 110 may include a sixth transistor M6.

The first electrode of the sixth transistor M6 may be coupled to the input signal terminal IPT. The second electrode of the sixth M6 may be coupled to the pull-up node pu. The switch electrode of the sixth transistor M6 may be coupled to the input signal terminal IPT.

The pull-up module 120 may include a seventh transistor M7.

The first electrode of the seventh transistor M7 may be coupled to the first clock signal terminal CLK. The second electrode of the seventh transistor M7 may be coupled to the output signal terminal OPT. The switch electrode of the seventh transistor M7 may be coupled to the pull-up node pu.

The pull-down module 130 may include an eighth transistor M8.

The first electrode of the eighth transistor M8 may be coupled to the power signal terminal VSS. The second electrode of the eighth transistor M8 may be coupled to the output signal terminal OPT. The switch electrode of the eighth transistor M8 may be coupled to the reset signal terminal RST.

The charging module 150 may include a capacitor C1.

One terminal of the capacitor C1 may be coupled to the pull-up node pu. The other terminal of the capacitor C1 may be coupled to the output signal terminal OPT.

The discharging module 160 may include a ninth transistor M9, a tenth transistor M10, and an eleventh transistor M11.

The first electrode of the ninth transistor M9 may be coupled to the power signal terminal VSS. The second electrode of the ninth transistor M9 may be coupled to the pull-up node pu. The switch electrode of the ninth transistor M9 may be coupled to the reset signal terminal RST.

The first electrode of the tenth transistor M10 may be coupled to the power signal terminal VSS. The second electrode of the tenth transistor M10 may be coupled to the pull-up node pu. The switch electrode of the tenth transistor M10 may be coupled to the pull-down node pd.

The first electrode of the eleventh transistor M11 may be coupled to the power signal terminal VSS. The second electrode of the eleventh transistor M11 may be coupled to the output signal terminal OPT. The switch electrode of the eleventh electrode may be coupled to the pull-down node pd.

In some embodiments, the first transistor M1, the second transistor M2, the third transistor M3, the fourth transistor M4, the fifth transistor M5, the sixth transistor M6, the seventh transistor M7, the eighth transistor M8, the ninth transistor M9, and the tenth transistor M10 may be N-type transistors. In certain other embodiments, dependent on the applications, the transistors M1-M11 may also be P-type transistors. The specific types of transistors M1-M11 should not be limited by the embodiments of the present disclosure.

In some embodiments, from the first transistor M1 to the eleventh transistor M11, each first electrode of a transistors may be the source electrode or the transistor, each second electrode of a transistor may be the drain electrode of the transistor, and each switch electrode of a transistor may be the gate electrode of the transistor.

As shown in FIG. 2(*a*), according to the disclosed GOA unit, in a discharging-pull down phase, the first clock signal terminal CLK may input a first-level voltage, the second clock signal terminal CLKB may input a second-level voltage, the input signal terminal IPT may input a first-level voltage, the reset signal terminal RST my input a second terminal, and the power signal terminal VSS may input a first-level voltage. Accordingly, the second clock signal terminal CLKB may have a high voltage level. The first transistor M1 and the fifth transistor M5 may be turned on. The second transistor M2 may write the second-level voltage of the second clock signal terminal CLKB into the pull-down node pd, and the voltage level at the pull-down node pd may be pulled up. The tenth transistor M10 and the eleventh transistor M11 may be turned on. At this time, the reset signal terminal RST may have a high voltage level. The ninth transistor M9 and the eighth transistor M8 may be turned on. At this time, the tenth transistor M10 and the ninth transistor M9 may write the first-level voltage of the power signal terminal VSS to the pull-up node pu. The eleventh transistor M11 and the eighth transistor M8 may write the first-level voltage of the power signal terminal VSS to the output signal terminal OPT. Thus, the power signal terminal VSS may pull down the voltage levels at the pull-up node pu and the output signal terminal OPT. Meanwhile, the diode D1, which has one directorial conductivity, may prevent the first clock signal terminal CLK from pulling down the voltage at the pull-down node pd and affecting the discharging process.

In a discharging-retaining phase, the first clock signal terminal CLK may input a second-level voltage, the second clock signal terminal CLKB may input a first-level voltage, the input signal terminal IPT may input a first-level voltage, the reset signal terminal RST may input a first-level voltage, and the power signal terminal VSS may input a first-level voltage. Accordingly, the node PD-CN may maintain a high voltage level. The second transistor M2 and the fifth transistor M5 may be kept on. The first clock signal terminal CLK may continue to pull up the voltage level at the pull-down node pd through the diode D1 and the fifth transistor M5. The tenth transistor M10 and the eleventh transistor M11 may be kept on. The tenth transistor M10 may write the first-level voltage of the power signal terminal VSS into the pull-up node pu and the output signal terminal OPT. The pull-up node pu and the output signal terminal OPT may maintain a low voltage level such that the noise at the pull-up node pu and the output signal terminal OPT may be reduced.

FIG. 2(*b*) illustrates the structure of a conventional GOA unit. The conventional GOA unit may include a buffering module (i.e., transistor M6), a pull-up module (i.e., transistor M7), a pull-down module (i.e., transistor M8), a retaining module (i.e., transistors M1, M2, M3, and M4), a charging module (i.e., capacitor C1), and a discharging module (i.e., transistors M9, M10, and M11). In the discharging-retaining phase, the pull-up node pu and the output signal terminal OPT may be floating (i.e., not being coupled to a high-level voltage nor a low-level voltage or being in an unstable state). The pull-up node pu and the output signal terminal OPT may be susceptible to noise, and thus the stability of the voltages at the pull-up node and the output signal terminal OPT may be adversely affected. For example, in the discharging-retaining phase, the voltage of the first clock signal terminal CLK may change from a low voltage level, in the discharging-pull down phase, to a high voltage level. Because of the parasitic capacitance in the seventh transistor M7, the voltage level at the pull-up node pu may be pulled up and the seventh transistor M7 may be turned on. The first clock signal terminal CLK may start re-charging the output signal terminal OPT. At this point, the voltages of the pull-up node pu and the output signal terminal OPT are both at a high voltage level. Noise exists in the pull-up node pu and the output signal terminal OPT.

In the embodiments of the present disclosure, the fifth transistor M5 and the diode D1 may be added in the disclosed GOA unit, as shown in FIG. 2(*a*). In the discharging-retaining phase, controlled by the voltage of the node PD-CN, the fifth transistor M5 may be turned on. The first clock signal terminal CLK may continue to pull up the voltage level at the pull-down node pd through the diode D1 and the fifth transistor M5. The tenth transistor M10 and the eleventh transistor M11 may be kept on. The tenth transistor M10 may write the first-level voltage of the power signal terminal VSS into the pull-up node pu and the output signal terminal OPT. The pull-up node pu and the output signal terminal OPT may be kept a low voltage level. Thus, noise at the pull-up node pu and the output signal terminal OPT may be reduced.

Thus, according to the disclosed GOA unit, the retaining module, controlled by the voltage of the second clock signal terminal, may write the voltage of the second clock signal terminal into the pull-down node or may write the voltage of the first clock signal terminal into the pull-down node. The discharging module, controlled by the voltages of the pull-down node and the reset signal terminal, may write the voltage of the power signal terminal into the pull-up node or into the output signal terminal. Compared to conventional technology, the voltages at the pull-up node and the output signal terminal may be lower, and the noise at the pull-up node and the output signal terminal of the GOA unit may be reduced.

Figure 3A:
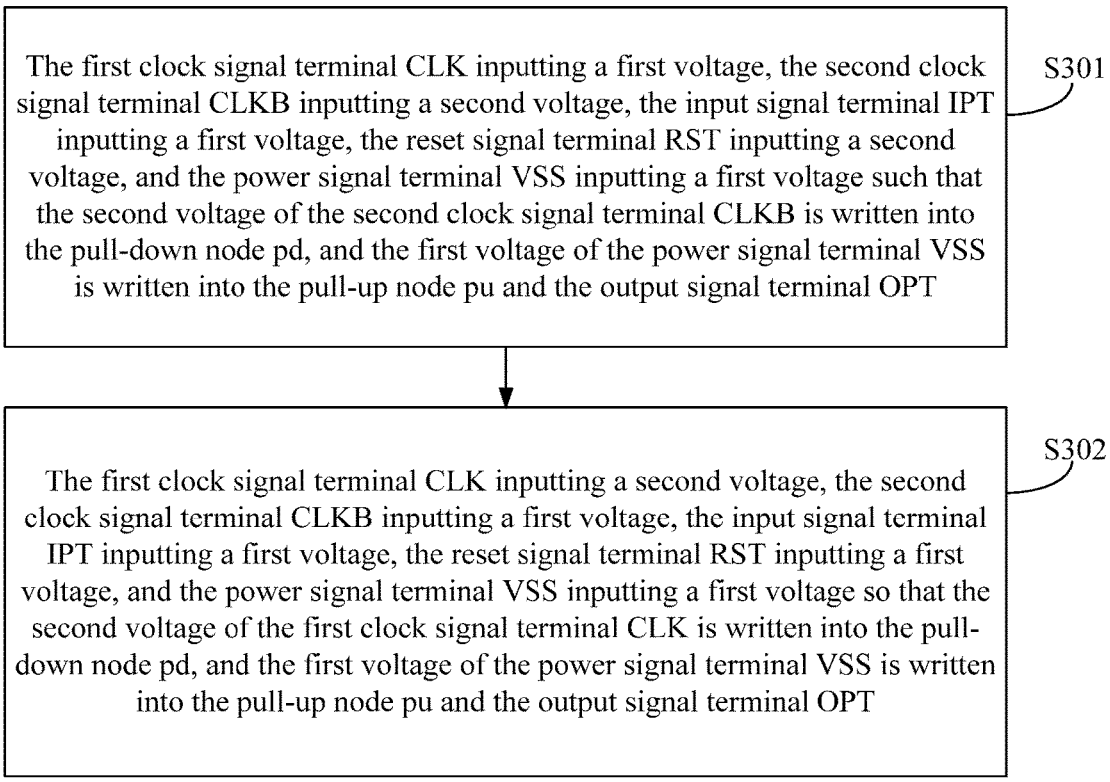
FIG. 3(*a*) illustrates an exemplary process flow of a method for driving a GOA unit according to some embodiments of the present disclosure.
Figure 3B:
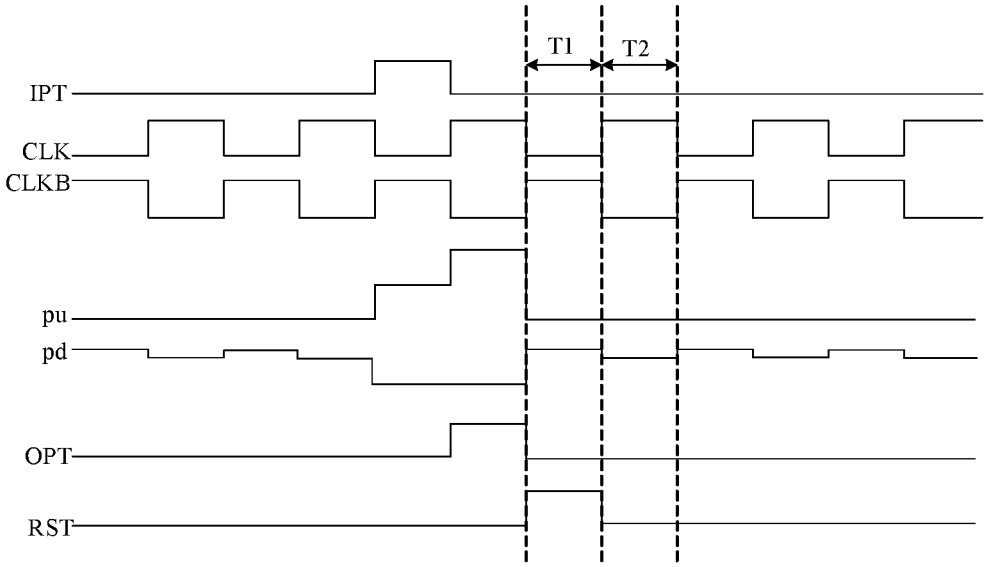
Figure 3C:
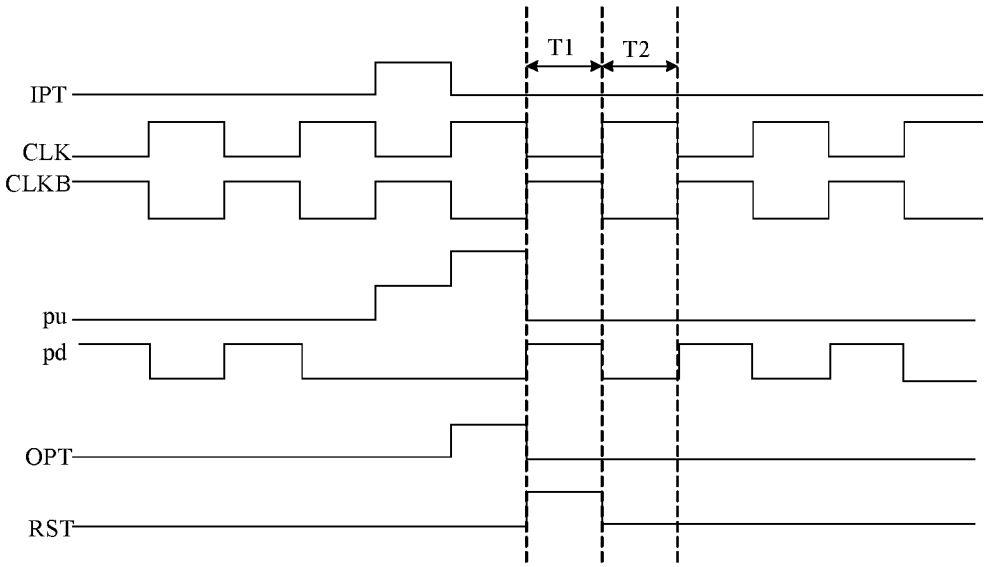

FIG. 3(*a*) illustrates an exemplary process flow of the method for driving the GOA unit. The disclosed method may be used to drive the GOA units shown in FIGS. 1 and 2(*a*). The GOA unit may include a buffering module 110, a pull-up module 120, a pull-down module 130, a retaining module 140, a charging module 150, and a discharging module 160. FIG. 3(*b*) illustrate an exemplary timing diagram of voltage signals according to the embodiment illustrated in FIG. 3(*a*). As shown in FIGS. 3(*a*) and 3(*b*), the method may include steps S301 and S302.

Step S301 may be performed in a pull-down stage T1. In the pull-down stage T1, the first clock signal terminal CLK may input a first-level voltage, the second clock signal terminal CLKB may input a second-level voltage, the input signal terminal IPT may input a first-level voltage, the reset signal terminal RST may input a second-level voltage, and the power signal terminal VSS may input a first-level voltage. Accordingly, the second-level voltage of the second clock signal terminal CLKB may be written into the pull-down node pd, and the first-level voltage of the power signal terminal VSS may be written into the pull-up node pu and the output signal terminal OPT.

Step S302 may be performed in a retaining stage T2. In the retaining stage T2, the first clock signal terminal CLK may input a second-level voltage, the second clock signal terminal CLKB may input a first-level voltage, the input signal terminal IPT may input a first-level voltage, the reset signal terminal RST may input a first-level voltage, and the power signal terminal VSS may input a first-level voltage. Accordingly, the second-level voltage of the first clock signal terminal CLK may be written into the pull-down node pd, and the first-level voltage of the power signal terminal VSS may be written into the pull-up node pu and the output signal terminal OPT.

Optionally, as shown in FIG. 2(*a*), the retaining module 140 may include the first transistor M1, the second transistor M2, the third transistor M3, the fourth transistor M4, the fifth transistor M5, and the diode D1. The buffering module 110 may include the sixth transistor M6. The pull-up module 120 may include the seventh transistor M7. The pull-down module 130 may include the eighth transistor M8. The charging module 150 may include the capacitor C1. The discharging module may include the ninth transistor M9, the tenth transistor M10, and the eleventh transistor M11.

Step S301 may include, in the pull-down stage T1, the first clock signal terminal CLK inputting a first-level voltage, the second clock signal terminal CLKB inputting a second-level voltage, the input signal terminal IPT inputting a first-level voltage, the reset signal terminal RST inputting a second-level voltage, and the power signal terminal VSS inputting a first-level voltage. Accordingly, the first transistor M1, the second transistor M2, and the fifth transistor M5 may be turned on. The second transistor M2 may write the second-level voltage of the second clock signal terminal CLKB into the pull-down node pd. The tenth transistor M10 and the eleventh transistor M11 may be turned on, and the ninth transistor M9 and the eighth transistor M8 may be turned on. The tenth transistor M10 and the ninth transistor M9 may write the first-level voltage of the power signal terminal VSS into the pull-up node pu. The eleventh transistor M11 and the eighth transistor M8 may write the first-level voltage of the power signal terminal VSS into the output signal terminal OPT.

The pull-down stage in step S301 may be the discharging-pull down phase. In the discharging-pull down phase, the first clock signal terminal CLK may input a first-level voltage, the second clock signal terminal CLKB may input a second-level voltage, the input signal terminal IPT may input a first-level voltage, the reset signal terminal RST may input a second-level voltage, and the power signal terminal VSS may input a first-level voltage. The second signal terminal CLKB may be at a high voltage level. The first transistor M1, the second transistor M2, and the fifth transistor M5 may be turned on. The voltage level at the pull-down node pd may be pulled up. The tenth transistor M10 and the eleventh transistor M11 may be turned on. The voltage of the reset signal terminal RST may be at a high voltage level. The ninth transistor M9 and the eighth transistor M8 may be turned on. At this point, the tenth transistor M10 and the ninth transistor M9 may write the first-level voltage of the power signal terminal VSS into the first pull-up node pu. The eleventh transistor M11 and the eighth transistor M8 may write the first-level voltage of the power signal terminal VSS into the output signal terminal OPT. Accordingly, the power signal terminal VSS may pull down the voltage levels of the pull-up node pu and the power signal terminal OPT. Meanwhile, the diode D1, having one directional conductivity, may prevent the first clock signal terminal CLK from pulling down the voltage level of the pull-down node pd and adversely affecting the discharging process.

The step S302 may include, in the retaining stage T2, the first clock signal terminal CLK inputting a second-level voltage, the second clock signal terminal CLKB inputting a first-level voltage, the input signal terminal IPT inputting a first-level voltage, the reset signal terminal RST inputting a first-level voltage, and the power signal terminal VSS inputting a first-level voltage. The second transistor M2 and the fifth transistor M5 may be turned on. The fifth transistor M5 may write the second-level voltage of the first clock signal terminal CLK into the pull-down node pd. The tenth transistor M10 and the eleventh transistor M11 may be turned on. The tenth transistor M10 may write the first-level voltage of the power signal terminal VSS into the pull-up node pu and the output signal terminal OPT.

The retaining stage T2 of step S302 may be the discharging-retaining phase. In the discharging-retaining phase, the first clock signal terminal CLK may input a second-level voltage, the second clock signal terminal CLKB may input a first-level voltage, the input signal terminal IPT may input a first-level voltage, the reset signal terminal RST may input a first-level voltage, and the power signal terminal VSS may input a first-level voltage. The voltage at PD-CN node may be at a high voltage level. The second transistor M2 and the fifth transistor M5 may be kept on. The fifth transistor M5 may write the second-level voltage of the first clock signal terminal CLK into the pull-down node pd. Accordingly, the first clock signal terminal CLK may pull up the voltage level at the pull-down node pd through the diode D1 and the fifth transistor M5. Meanwhile, the tenth transistor M10 and the eleventh transistor M11 may be kept on. The tenth transistor M10 may write the first-level voltage of the power signal terminal VSS to the pull-up node pu. The eleventh transistor M11 may write the first-level voltage of the power signal terminal VSS to the output signal terminal OPT. The voltages at the pull-up node pu and the output signal terminal OPT may be kept at a low voltage level such that the noise at the pull-up node pu and the output signal terminal OPT may be reduced.

In the disclosed embodiments, the voltage changes, in the pull-down stage T1 and the retaining stage T2, of the input signal terminal IPT, the first clock signal terminal CLK, the second clock signal terminal CLKB, the pull-up node pu, the pull-down node pd, the output signal terminal OPT, and the reset signal terminal RST may be illustrated in FIG. 3(*b*). Controlled by the voltage at PD-CN node, the fifth transistor M5 may be turned on. The first clock signal terminal CLK may continue to pull up the voltage level of the pull-down node pd through the diode D1 and the fifth transistor M5. The tenth transistor M10 and the eleventh transistor M11 may be kept on. The tenth transistor M10 may write the first-level voltage of the power signal terminal VSS into the pull-up node pu. The eleventh transistor M11 may write the first-level voltage of the power signal terminal VSS to the output signal terminal OPT. The voltages at the pull-up node pu and the output signal terminal OPT may be kept at a low voltage level such that the noise at the pull-up node pu and the output signal terminal OPT may be reduced.

The voltage changes, in the pull-down stage T1 and the retaining stage T2, of the conventional GOA unit shown in FIG. 2(*b*), may be shown in FIG. 3(*c*). The voltages changes of the input signal terminal IPT, the first clock signal terminal CLK, the second clock signal terminal CLKB, the pull-up node pu, the pull-down node pd, the output signal terminal OPT, and the reset signal terminal RST may be shown in FIG. 3(*c*). A comparison between FIG. 3(*b*) and FIG. 3(*c*) illustrates that, compared to conventional technology, in the disclosed method for driving the GOA unit, the first clock signal terminal CLK may continue to pull down the voltage level of the pull-down node pd through the second diode D1 and the fifth transistor M5. The tenth transistor M10 and the eleventh transistor M11 may be kept on so that the voltages of the pull-up node and the output signal terminal OPT may be kept at a low voltage level.

Thus, noise at the pull-up node pu and the output signal terminal OPT may be reduced.

In the present disclosure, the retaining module, controlled by the voltage of the second clock signal terminal, may write the voltage of the second clock signal terminal into the pull-down node or write the voltage of the first clock signal terminal into the pull-down node. Thus, the discharging module, controlled by the voltages of the pull-down node and the reset signal terminal, may write the voltage of the power signal terminal to the pull-up node or to the output signal terminal. Compared to conventional technology, the voltages at the pull-up node and the output signal terminal may be lower, and noise at the pull-up node and the output signal terminal of the disclosed GOA unit may be reduced.

Another aspect of the present disclosure provides a GOA circuit. The GOA circuit may include at least two cascading GOA units. Each GOA unit may be the GOA unit shown in FIG. 1 or FIG. 2(*a*).

The disclosed GOA circuit may include at least two cascading GOA units. For each GOA unit, the retaining module, controlled by the voltage of the second clock signal terminal, may write the voltage of the second clock signal terminal to the pull-down node or write the voltage of the first clock signal terminal to the pull-down node. Thus, the discharging module, controlled by the voltages of the pull-down node and the reset signal terminal, may write the voltage of the power signal terminal to the pull-up node or to the output signal terminal. Compared to conventional technology, the voltages at the pull-up node and the output signal terminal may be lower, and noise at the pull-up node and the output signal terminal of the disclosed GOA unit may be reduced.

Another aspect of the present disclosure provides a display device. The display device may include one or more of the disclosed GOA circuits. The display device may be an LCD panel, an electronic paper, an organic light-emitting diode (OLED) panel, a mobile phone, a tablet computer, a television, a monitor, a laptop computer, a digital frame, a navigation device, or any suitable parts or products with display functions.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A gate driver on array (GOA) unit, comprising: a buffering module, a pull-up module, a pull-down module, a retaining module, a charging module, and a discharging module, a pull-up node being coupled to the buffering module, the discharging module, the pull-up module, and the charging module, and a pull-down node being coupled to the discharging module and the retaining module, wherein: the buffering module, being coupled to an input signal terminal and a pull-up node and controlled by a voltage of the input signal terminal, is configured to output the voltage of the input signal terminal into the pull-up node; the pull-up module, being coupled to a first clock signal terminal, the pull-up node, and an output signal terminal and controlled by a voltage of the pull-up node, is configured to output a voltage of the first clock signal terminal into the output signal terminal; the pull-down module, being coupled to the output signal terminal, a reset signal terminal, and a power signal terminal and controlled by a voltage of the reset signal terminal, is configured to output a voltage of the power signal terminal into the output signal terminal; the retaining module, being coupled to the first clock signal terminal, the power signal terminal, the pull-up node, the pull-down node, and a second clock signal terminal and controlled by a voltage of the second clock signal terminal, is configured to output the voltage of the second clock signal terminal into the pull-down node or write a voltage of the first clock signal terminal into the pull-down node; the charging module, being coupled to the pull-up node and the output signal terminal, is configured to store voltages of the pull-up node and the output signal terminal; the discharging module, being coupled to the reset signal terminal, the pull-up node, the power signal terminal, the pull-down node, and the output signal terminal, is configured to output the voltage of the power signal terminal into the pull-up node or into the output signal terminal when the discharging module is controlled by voltages of the pull-down node and the reset signal terminal, and configured to write the voltage of the power signal terminal into the pull-up node and the output signal terminal when the discharging module is controlled by the voltage of the pull-down node; and wherein: the retaining module further includes a first transistor, a second transistor, a third transistor, a fourth transistor, a fifth transistor, and a diode, the first transistor having a first electrode coupled to the second clock signal terminal, a second electrode of the first transistor coupled to a switch electrode of the second transistor, a switch electrode of the fifth transistor, and a second electrode of the fourth transistor, and a switch electrode of the first transistor coupled to the second clock signal terminal; the second transistor having a first electrode coupled to the second clock signal terminal, a second electrode coupled to the pull-down node; the third transistor having a first electrode coupled to the power signal terminal, a second electrode coupled to the pull-down node, and a switch electrode coupled to the pull-up node and a switch electrode of the fourth transistor; the fourth transistor having a first electrode coupled to the power signal terminal;

the fifth transistor having a first electrode coupled to a cathode of the diode, and a second electrode coupled to the pull-down node; and the diode having an anode coupled to the first clock signal terminal.

2. The GOA unit according to claim 1, wherein: the buffering module further includes a sixth transistor, the sixth transistor having a first electrode coupled to the input signal terminal, a second electrode coupled to the pull-up node, and a switch electrode coupled to the input signal terminal.

3. The GOA unit according to claim 1, wherein: the pull-up module includes a seventh transistor, the seventh transistor having a first electrode coupled to the first clock signal terminal, a second electrode coupled to the output signal terminal, and a switch electrode coupled to the pull-up node.

4. The GOA unit according to claim 3, wherein: the pull-down module includes an eighth transistor, the eighth transistor having a first electrode coupled to the power signal terminal, a second electrode coupled to the output signal terminal, and a switch electrode coupled to the reset signal terminal.

5. The GOA unit according to claim 1, wherein: the charging module includes a capacitor, the capacitor having a terminal coupled to the pull-up node, and another terminal coupled to the output signal terminal.

6. The GOA unit according to claim 1, wherein: the discharging module includes a ninth transistor, a tenth transistor, and an eleventh transistor, the ninth transistor having a first electrode coupled to the power signal terminal, a second electrode coupled to the pull-up node, and a switch electrode coupled to the reset signal terminal;

the tenth transistor having a first electrode coupled to the power signal terminal, a second electrode coupled to the pull-up node, and a switch electrode coupled to the pull-down node; and the eleventh transistor having a first electrode coupled to the power signal terminal, a second electrode coupled to the output signal terminal, and a switch electrode coupled to the pull-down node.

7. The GOA unit according to claim 1, wherein the first transistor, the second transistor, the third transistor, the fourth transistor, the fifth transistor, the sixth transistor, the seventh transistor, the eighth transistor, the ninth transistor, the tenth transistor, and the eleventh transistor are N-type transistors.

8. The GOA unit according to claim 7, wherein the first electrode of any of the transistors is a source electrode, the second electrode of any of the transistors is a drain electrode, and the switch electrode of any of the transistors is a gate electrode.

9. A method for driving a GOA unit according to claim 1, comprising implementing a pull-down stage and a retaining stage, wherein, the pull-down stage including:

applying a first-level voltage on the first clock signal terminal, the input signal terminal, and the power signal terminal;

applying a second-level voltage on the second clock signal terminal and the reset signal terminal;

applying the second-level voltage on a terminal of the discharging module coupled to the retaining module, and applying the first-level voltage on the output signal terminal; and the retaining stage including:

applying the first-level voltage on the second clock signal terminal, the input signal terminal, the reset signal terminal, and the power signal terminal;

applying the second-level voltage on the first clock signal terminal;

applying the second-level voltage on the pull-down node; and applying the first-level voltage of the power signal terminal on the pull-up node and the output signal terminal.

10. The method according to claim 9, wherein the first-level voltage is a voltage of low voltage level and the second-level voltage is a voltage of high voltage level.

11. The method according to claim 10, the retaining module including the first transistor, the second transistor, the third transistor, the fourth transistor, the fifth transistor, and the diode; the buffering module including the sixth transistor; the pull-up module including the seventh transistor; the pull-down module including the eighth transistor; the charging module including the capacitor; the discharging module including the ninth transistor, the tenth transistor, and the eleventh transistor, wherein:

in the pull-down stage, the first-level voltage is applied on the first clock signal terminal, the input signal terminal, and the power signal terminal, and the second-level voltage is applied on the second clock signal terminal and the reset signal terminal, so that, the first transistor, the second transistor, the fifth transistor, the eighth transistor, the ninth transistor, the tenth transistor, and the eleventh transistor are turned on, the second transistor writing the second-level voltage of the second clock signal terminal into the pull-down node, the tenth transistor and the ninth transistor writing the first-level voltage of the power signal terminal into the pull-up node, the eleventh transistor and the eighth transistor writing the first-level voltage of the power signal terminal into the output signal terminal; and in the retaining stage, a first-level voltage is applied on the second clock signal terminal, the input signal terminal, the reset signal terminal, and power signal terminal, and a second-level voltage is applied on the first clock signal terminal, so that, the second transistor, the fifth transistor, the tenth transistor, and the eleventh transistor are turned on, the fifth transistor writing the second-level voltage of the first clock signal terminal into the pull-down node, the tenth transistor writing the first-level voltage of the power signal terminal into the pull-up node and the output signal terminal.

12. A GOA circuit, comprising at least two cascading GOA units according to claim 1.

13. A display device, comprising one or more of the GOA units according to claim 1.

* * * * *